United States Patent [19]

Postbeschild

[11] Patent Number: 4,665,630

[45] Date of Patent: May 19, 1987

[54] WARM-AIR HAND DRYING INSTALLATIONS

[75] Inventor: John W. Postbeschild, Witney, England

[73] Assignee: Smiths Industries Public Limited Company, London, England

[21] Appl. No.: 895,095

[22] Filed: Aug. 11, 1986

[30] Foreign Application Priority Data

Sep. 4, 1985 [GB] United Kingdom ..... 8522015

[51] Int. Cl.[4] ..... F26B 19/00

[52] U.S. Cl. ..... 34/54; 34/202; 34/224; 34/233; 34/243 R; 219/367

[58] Field of Search ..... 219/367, 368; 34/202, 34/46, 48, 54, 53, 243 R, 225, 233

[56] References Cited

FOREIGN PATENT DOCUMENTS 37478 12/1930 France ..... 34/202

2137878 10/1984 United Kingdom .

633519 11/1978 U.S.S.R. ..... 34/202

*Primary Examiner*—Larry I. Schwartz

*Attorney, Agent, or Firm*—Pollock, Vande Sande and Priddy

[57] ABSTRACT

A warm-air hand drying installation has a floor-mounted pedestal with several drying apparatus around its periphery. A single fan supplies air to each apparatus via a central duct when any one of the apparatus is switched on. Each apparatus has a flap valve and a heater. The valve covers either the outlet of the apparatus or a side opening into the pedestal. When any one of the apparatus is switched on, the heater is energized and its valve opens to allow air flow to its outlet and onto the hands of the user. The heaters of other apparatus are not energized and their valves remain positioned such that air flow to the apparatus is directed internally between the pedestal casing and the duct, to the fan inlet. In this way, air flow can be maintained constant regardless of the number of apparatus in use. The fan remains on for a time longer than the heater.

10 Claims, 5 Drawing Figures

WARM-AIR HAND DRYING INSTALLATIONS

BACKGROUND OF THE INVENTION

This invention relates to warm-air drying installations for drying hands or other parts of the body.

The invention is more particularly concerned with installations including several hand drying apparatus each of which receive air from the same air moving means.

One example of a previous installation is described in British Patent Application No. GB No. 2 137 878A in which a pedestal has eight or six hand drying outlets disposed about it. Such arrangements are advantageous because they only require one fan or other means for producing airflow, thereby leading to a compact, low-cost installation. In previous such installations, each outlet has a foot pedal, or similar switch, the operation of which opens a flap and turns on a heater associated with the outlet, so that warm air is blown out of the outlet over the user's hands. Difficulties, however, arise because the quantity of air needed to be produced by the fan will vary according to the number of apparatus in use at the time. If the fan is arranged to produce a constant total airflow there will be considerable differences in the airflow at any one outlet according to the number in use. It has been found impracticable to vary the total airflow produced by the fan, in order to maintain a constant flow at the outlets regardless of the number in use, since this requires very large speed variations of the fan and its driving motor. Also, this would result in a considerable loss of fan air pressure.

One solution of this problem is to arrange the installation such that air is blown out of all the apparatus outlets when any one apparatus is operated. However, if the air at all outlets is heated, this is wasteful. If, instead, only that outlet in use is heated and the others blow out unheated air, this will lead to draughts and will cause confusion to users since they may try to dry their hands at an outlet which is blowing out unheated air.

SUMMARY OF THE INVENTION

It is an object of the present invention to provide warm air drying installations by which these problems can be alleviated.

According to the present invention there is provided an installation comprising a plurality of warm-air hand drying apparatus each of which is arranged to receive air from the same air moving means, each said apparatus including individually operable heating means and valve means arranged to allow air to flow onto the user from apparatus in use and to allow air to flow internally of the installation from apparatus not in use when the air moving means is operative such that the air moving means provides a substantially constant airflow regardless of the number of said apparatus in use.

Each apparatus preferably has a first opening through which air flows onto the user and a second opening through which air flows internally of the installation, the valve means being arranged to close said first and second opening, and the resistance to air flow through said first and second openings when open being substantially the same. The valve means may include a flap that is pivoted to move between positions in which it covers the first or second opening respectively. The valve means in each apparatus may be located downstream of the respective heating means.

The installation preferably has a casing along which air from apparatus not in use is directed internally, the air moving means having an inlet within the casing through which some at least of the air directed internally of the installation is moved back to the apparatus. The installation may include a control unit arranged to cause the air moving means to operate for an interval longer than the heating means. The control unit may be arranged to displace the valve means and to energize the heating means at substantially the same time. The control unit may be arranged to energize each heating means independently for a fixed time period following initiation of operation of the respective apparatus. The control means is preferably arranged to energize the air moving means for a predetermined interval following initiation of operation of any one said apparatus each time operation of any one of said apparatus is initiated such that the air moving means remains in operation until the end of the interval of the last of the apparatus to be initiated.

The installation preferably includes a casing, the apparatus being disposed around the periphery of the casing. The casing may be supported centrally on the floor.

The installation may include a duct that extends centrally within the casing from the air moving means, air directed internally from apparatus not in use flowing along the installation between the duct and the casing. Each apparatus may include a displaceable member at its outlet which can be positioned to direct flow onto the user's hands or onto the user's face. The air moving means may include an electrically driven fan. Each heating means may include an electrical heater.

A hand dryer installation according to the present invention will now be described, by way of example, with reference to the accompanying drawings.

DETAILED DESCRIPTION

Figure 1:
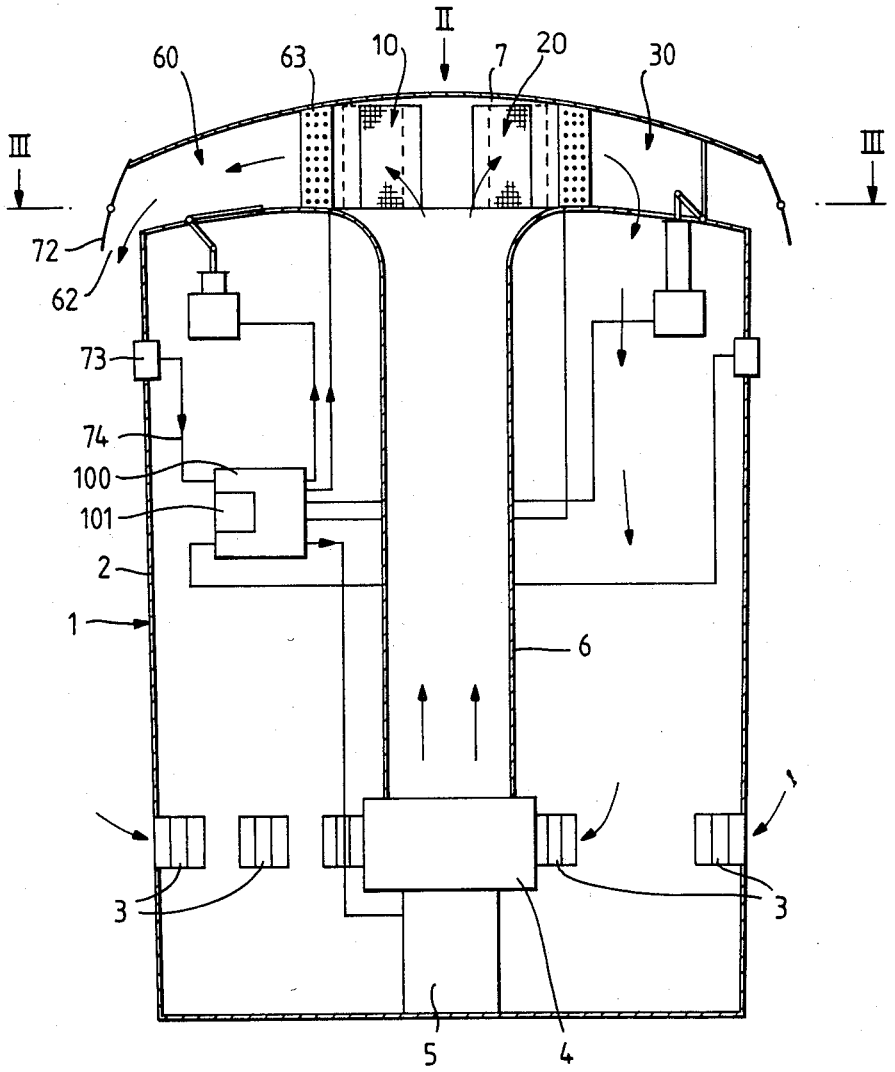
FIG. 1 is a sectional side elevation showing the installation schematically.
Figure 2:
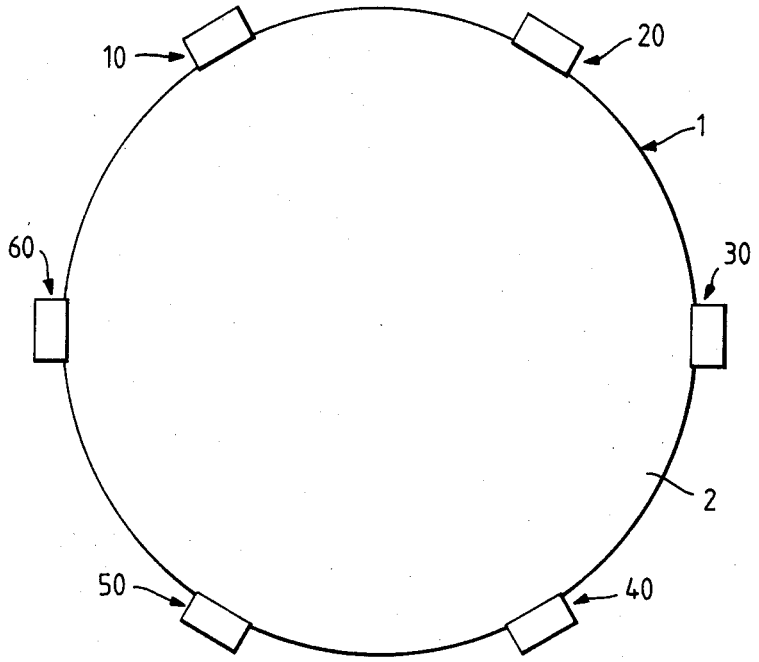
FIG. 2 is a plan view of the installation in the direction of the arrow II of FIG. 1.
Figure 3:
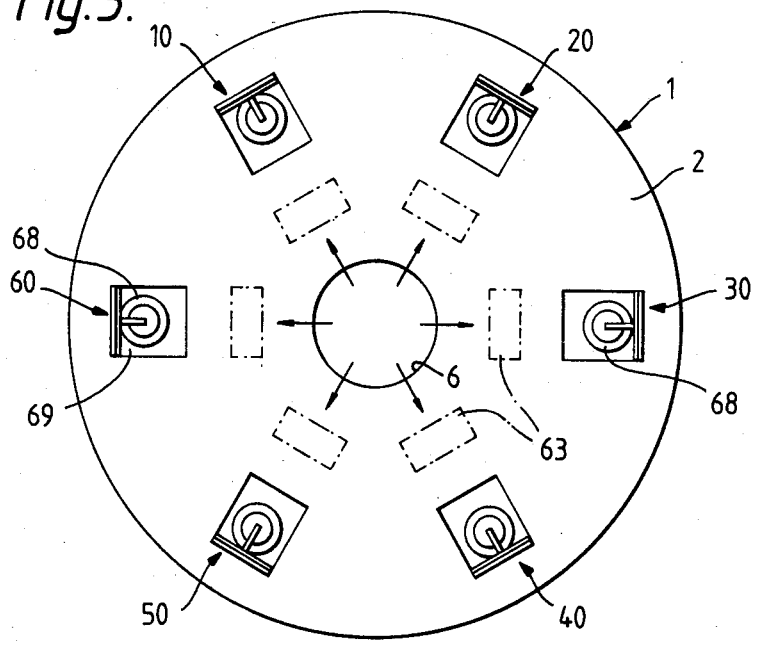
FIG. 3 is a transverse section through the installation along the line III—III of FIG. 1.

With reference first to FIGS. 1 to 3, the hand dryer installation is in the form of a pedestal 1 for standing on the floor, and contains six hand dryer apparatus 10 to 60 about its upper end.

The pedestal 1 comprises a generally cylindrical casing 2 having air inlet grills 3 disposed around it, towards its lower end. The grills 3 are located at least 38 cm above the floor to avoid bacterial contamination. The casing 2 contains air moving means, such as a fan 4 driven by an electric motor 5. The fan 4 has an inlet within the casing 2 that draws air into the casing through the grills 3 and blows it upwardly along a duct 6 which extends coaxially of the casing 2. At its upper end, the duct 6 opens into a plenum chamber 7 which supplies air to each of the hand dryer apparatus 10 to 60.

Figure 4:
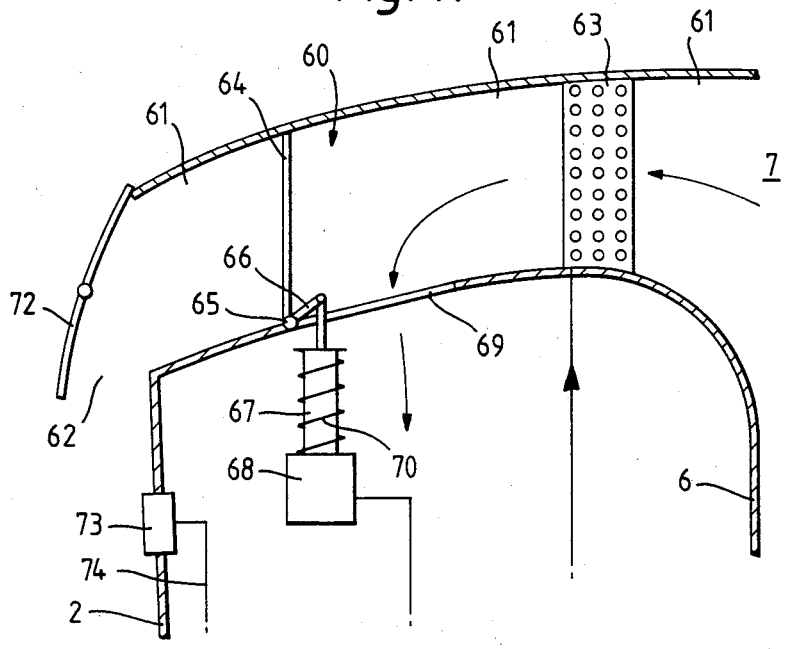
FIG. 4 is an enlarged sectional side elevation showing one of the hand dryer apparatus in the installation when the apparatus is in operation.
Figure 5:
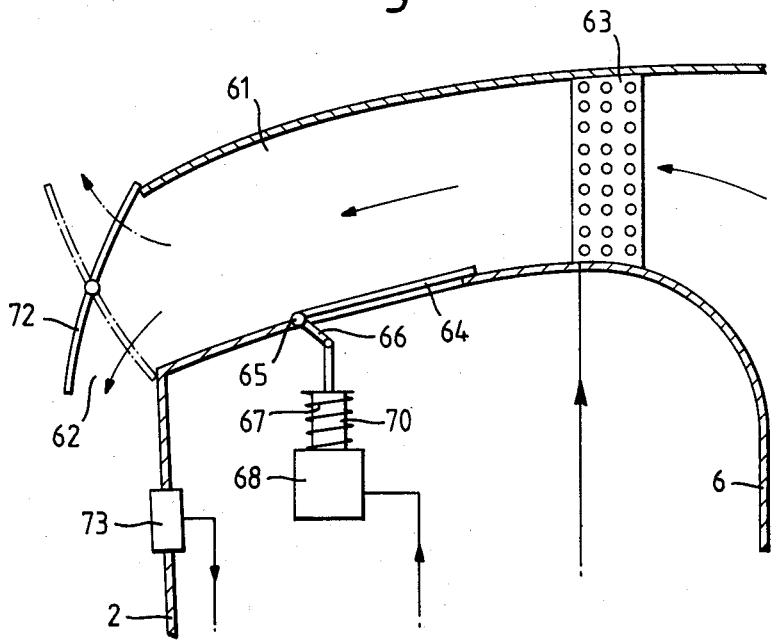
FIG. 5 shows the same apparatus as in FIG. 4, when the apparatus is operative.

Referring now also to FIGS. 4 and 5 which show one of the apparatus 60 (although the other apparatus 10 to 50 are all of the same construction), the apparatus includes an air passage 61 which extends from the plenum chamber 7, at its upstream end, to an outlet opening 62 at the periphery of the casing 2. Mounted in the air passage 61 is an electrical heating element 63, or other air heating means, which can be energized by current from a control unit 100. Downstream of the heating element 63 there is valve means in the form of a flap 64 that is hinged about its downstream edge 65. A short crank arm 66 projects from the downstream edge 65 and is pivotally connected to the arm 67 of a solenoid 68.

The air passage 61 has a side opening 69 of substantially the same shape and size as the flap 64. The side opening 69 communicates between the air passage 61 and the interior of the casing 2, around the duct 6. In its normal position, when the apparatus 60 is not in use, the flap 64 is held up by a spring 70 (as shown in FIG. 4) to prevent air flow along the passage 61 to the outlet opening 62 and to direct airflow instead through the side opening 69. When the solenoid 68 is actuated, it pulls down the flap 64 (as shown in FIG. 5) to cover the side opening 69 and to permit airflow along the passage 61 to the outlet 62.

At the outlet 62 there is a pivoted plate 72 which normally directs the outlet airflow downwardly to the hands of the user. The plate 72 can be displaced to the position shown by the broken lines in FIG. 5 in which airflow is diverted upwardly, for use in drying the user's face. Once the plate 72 has been displaced to direct air onto the user's face it is maintained in that position by the pressure of airflow. When airflow ceases, the plate 72 returns by gravity, or by means of a spring, to its normal position, for hand drying. A simple detent mechanism requiring manual resetting could, alternatively, be used.

The apparatus 60 includes a switch 73 for initiating operation of that apparatus. The switch 73 is mounted close to the outlet 62 of the apparatus, or may be mounted at the base of the pedestal 1 for operation by the user's foot. The switch 73 may be a push-button, a touchsensitive switch, a proximity switch or any other conventional switch. The switch 73 is connected by a line 74 to the control unit 100.

The control unit 100 is operable to control operation of the fan 4, the heating elements 63 and the solenoids 68. The control unit 100 includes a timer 101 so that, once a switch 73 has been actuated, the associated apparatus delivers a heated airflow to the user's hands or face for a predetermined time after which airflow through the outlet 62 ceases.

When the installation is not in use, the fan 4 is stationary, the flap 64 of each apparatus 10 to 60 is in its upper position blocking aiflow out of its respective outlet 62, the heating element 63 of each apparatus is unenergized, and each plate 72 is in a position in which any airflow would be diverted to the user's hands.

When the switch 73 of any apparatus 10 to 60 is actuated, this starts a first time cycle (of, for example, 30 seconds) in the control unit 100 which energizes the motor 5 so that the fan 4 draws air into the casing 2 through the grills 3 and blows this into the plenum chamber 7 via the duct 6. At the same time, the heating element 63 of the associated apparatus 60 is energized to heat air flowing along its air passage 61, while the heating elements of those apparatus not in use remain unenergized. The solenoid 68 of the apparatus in use is also energized so as to pull down the crank arm 66 and pivot the flap 64 in a clockwise sense, so that it opens the air passage 61 to the outlet 62 while closing the side opening 69. The flaps 64 of those apparatus not in use remains up, so that their respective side opening remains open. In this way, air flows from the plenum chamber 7 along the air passage 61 of each apparatus 10 to 60 but is diverted through the side apertures 69 of those apparatus not in use so that it flows downwardly internally of the installation between the casing 2 and the duct 6. Most of this diverted air will flow back into the fan 4 although a small amount may diffuse out through the grill 3, to be subsequently drawn in again by the fan 4.

Air flowing along the passage 61 of the apparatus in use is heated by its heating element 63 and this heated air is directed onto the hands of the user via the outlet 62.

At the end of the first timing cycle, the solenoid 68 is de-energized allowing the spring 70 to return the flap valve 64 to the position in which the outlet 62 is closed. At the same time, the heating element 63 is also de-energized. The motor 5, however, remains on for a second time cycle (typically, 40 seconds) so that the fan 4 continues to circulate air within the pedestal 1. At the end of the second time cycle, the motor 5 is turned off and the fan 4 comes to rest.

If a second person should wish to use the installation at the same time as the first person, he goes to another one of the apparatus 10 to 50 around the pedestal 1. When he actuates the switch 73 associated with that apparatus, this causes the respective flap 64 to be pulled down and the respective heating element 63 to be energized. The time period for which the heating element 63 and flap valve 64 of the other apparatus is rendered operative runs independently of that of the first apparatus to be used. The timing period for the motor 5 and fan 4, however, is restarted so that they remain on until the end of the second time cycle of the last apparatus to be actuated.

It will be appreciated that there need be no appreciable change in the airflow experienced by one user when additional drying apparatus are used, since the air pressure within the plenum chamber 7 remains substantially unchanged regardless of the number of apparatus in use. In this respect, the size and shape of the side apertures 69 are selected such that they present substantially the same resistances to airflow as the outlets 62.

By ensuring that the fan 4 and motor 5 remain on after the heating element 63 has been de-energized, the build-up of heat in the area of the heating element is reduced. Also, the number of starting up times of the motor and fan is reduced, where the installation is being used frequently. This prolongs the life of the motor 5 and ensures a smooth, continuous action and air delivery. The installation can also be quieter than conventional dryers in which each dryer has its own fan.

It will be appreciated that other forms of heating element could be utilized, such as, for example including a heat exchanger heated by burning gas or by flow of a heated liquid. Other forms of air moving means could be used instead of a fan, such as, for example, a compressed air blower. The installation need not take the form of a pedestal with hand dryer apparatus around its edge but could instead, for example, have a casing that extends along the wall of a room, with hand dryer outlets located along it.

What I claim is:

1. An installation comprising an air moving device, a plurality of warm-air hand drying apparatus, and means connecting said air moving device to supply air to each of said apparatus; each said apparatus including an individually operable heater that can heat air flowing through the apparatus, a first and second opening, and a valve device, said valve device being operable to close either said first or second opening such that air either flows through said second opening internally of the installation from apparatus not in use or through said first opening onto the user from an apparatus in use, the size of said first and second openings being such that resistance to airflow through each opening when open is substantially the same whereby the air moving device provides a substantially constant airflow regardless of the number of said apparatus in use.

2. An installation according to claim 1, wherein said valve device in each apparatus is located downstream of the respective heater.

3. An installation according to claim 1, including a control unit which controls the air moving device to operate for an interval longer than the heater.

4. An installation according to claim 1, including a control unit which displaces the valve device and energizes the heater at substantially the same time.

5. An installation according to claim 1, including a control unit, and wherein the control unit energises each heater independently for a fixed time period following initiation of operation of the respective apparatus.

6. An installation according to claim 5, wherein the control unit energizes the air moving device for a predetermined interval following initiation of operation of any one said apparatus each time operation of any one of said apparatus is initiated such that the air moving device remains in operation until the end of the interval of the last of the apparatus to be initiated.

7. An installation comprising an air moving device having an inlet and an outlet, a plurality of warm-air hand drying apparatus, a casing, and means connecting the outlet of said air moving device to supply air to each of said apparatus; each said apparatus including an individually operable heater that can heat air flowing through the apparatus, and a valve device, said valve device being operable when said air moving device is operative to allow air to flow onto a user from an apparatus in use and to allow air to flow internally of the casing from apparatus not in use such that the air moving device thereby provides a substantially constant airflow regardless of the number of said apparatus in use; the said inlet of the air moving device being located in the casing so that some at least of the air directed internally of the installation from apparatus not in use is moved back to the apparatus.

8. An installation according to claim 2, wherein the said apparatus are disposed around the periphery of the casing.

9. An installation according to claim 8, wherein the casing is supported centrally on the floor.

10. An installation comprising: an outer casing; an air moving device located within said casing, said air moving device having an inlet that opens within the interior of the casing; a plurality of warm-air hand drying apparatus in said casing and opening therefrom; ducting connecting said air moving device to supply air to each of said apparatus; a heater including in each said apparatus; each said heater being individually operable to heat air flowing through that apparatus; and a flap valve included in each said apparatus, each said flap valve being operable to allow air from said air moving device to flow out of the apparatus onto the user when that apparatus is in use, and to allow air to flow internally of the casing outside the ducting towards the inlet of said air moving device from apparatus not in use, the resistance to flow of air from apparatus in use and from apparatus not in use being substantially the same such that the air moving device thereby provides a substantially constant airflow regardless of the number of said apparatus in use.

* * * * *